US006014771A

United States Patent [19]

Kirven

[11] Patent Number: 6,014,771

[45] Date of Patent: Jan. 18, 2000

[54] KNEE PROTECTION KIT

[76] Inventor: Marie Kirven, 19 Fabyan Rd., Plymouth, Mass. 02360

[21] Appl. No.: 09/244,547

[22] Filed: Feb. 3, 1999

[51] Int. Cl.[7] ..... A41D 13/00; A41D 27/20

[52] U.S. Cl. ..... 2/23; 2/24; 2/227; 2/247

[58] Field of Search ..... 2/23, 227, 267, 2/24, 79, 268, 247, 249, 250, 251, 69

[56] References Cited

U.S. PATENT DOCUMENTS

| | | | |
|---|---|---|---|
| 105,858 | 7/1870 | Sloan | 2/227 |
| 588,907 | 8/1897 | Herbelin . | |
| 671,059 | 4/1901 | Sanders . | |
| 727,243 | 5/1903 | White . | |
| 932,990 | 8/1909 | Madill et al. . | |
| 1,304,613 | 5/1919 | Smedley . | |
| 1,711,611 | 5/1929 | Mock . | |
| 2,355,193 | 8/1944 | Walker . | |
| 2,568,083 | 9/1951 | Mitchell . | |
| 3,166,762 | 1/1965 | Winkworth . | |
| 3,168,746 | 2/1965 | Smith . | |
| 4,035,844 | 7/1977 | Atack et al. . | |
| 4,561,124 | 12/1985 | Thompson . | |
| 4,613,991 | 9/1986 | Grover . | |
| 4,831,666 | 5/1989 | Drnman . | |
| 4,920,577 | 5/1990 | Scharf . | |
| 5,038,408 | 8/1991 | DeBaene . | |
| 5,054,127 | 10/1991 | Zevchak | 2/247 |
| 5,134,726 | 8/1992 | Ross . | |
| 5,617,587 | 4/1997 | Marchbanks | 2/247 |
| 5,737,775 | 4/1998 | Schwartz | 2/247 |
| 5,809,576 | 9/1998 | Huston et al. | 2/247 |
| 5,920,902 | 7/1999 | Crampton | 2/24 |

*Primary Examiner*—John J. Calvert
*Assistant Examiner*—Tejash Patel
*Attorney, Agent, or Firm*—John P. McGonagle

[57] ABSTRACT

A knee protection kit comprised of two separate fabric pockets, one for each knee of a pair of pants. The kit also contains a liquid fabric glue for attachment of each pocket to a corresponding pants knee area. Each pocket may be attached to the pants' exterior knee area or interior knee area. Each pocket also contains a closable flap with a fastener. The kit provides three pairs of pads, one pair made from neoprene material or the like, the second pair made from a hard, plastic shell material or the like, and the third pair made from a lambs' wool material or the like. The neoprene and plastic pads are each adapted to fit into a pocket. The lamb's wool pads are adapted to being glued to the outside of a pocket if the pocket is attached to the interior of the pants; otherwise the lamb's wool pads are attached directly to the interior of the pants in the knee area.

9 Claims, 2 Drawing Sheets

KNEE PROTECTION KIT

BACKGROUND OF THE INVENTION

This invention relates generally to pants, and more particularly to a kit providing different means for protecting knees.

Various activities require a great deal of time in a kneeling position wherein knees are often in contact with a floor, roof or with work tools. Various recreational activities, such as biking and roller blading often bring a person's knees into contact with different surfaces. Workmen, such as mechanics, gardeners, plumbers, miners, roofers, carpet layers, and the like, as well as sports and recreational enthusiasts, require sufficient protection in the knee area to protect against injury by stones or other hard substances or irregularities or rough texture on the surface of the ground or other place upon which the wearer is obliged to kneel or likely to have his or her knees come into contact with a relatively hard or irregular surface.

Knee protection requirements for different professions and recreational activities, and even within a particular profession or activity, vary from hard absolute protection from projectiles and particularly irregular textured surfaces, to softer protection where kneeling on a smooth, albeit hard surface, may last for lengthy periods of time. Workmen even need protection from the constant rubbing of heavy, rough clothing against their knees.

Various strap-attached knee pads have been proposed for knee protection, especially hard, absolute protection. However, such straps tend to twist, fall down, and constrict the knee area, causing discomfort. They also allow the knee pad itself to become dislodged from its proper position, thus requiring frequent readjustment.

Another approach to knee area protection is seen in fabric pants that incorporate permanent knee pads into their construction, especially softer protection. However, permanently attached knee pads require a compromise between ease of laundering and pad size, type or thickness. Pants of this type are also limited to one type of pad necessitating a second and even third pair of pants or strap on pads for other needed types of protection.

SUMMARY OF THE INVENTION

In view of the forgoing disadvantages inherent in both the traditional method and attempts to improve on it, the present invention provides an improved means and method for protecting a person's knees from a wide variety hazards. As such, the general purpose of the present invention, which will be described subsequently in greater detail is to provide a simple, efficient, convenient to use, flexible, and inexpensive means of applying a wide variety of protection means to a person's knees.

To attain this, the present invention provides a kit comprised of two separate fabric pockets, one for each knee of a pair of pants. The kit also contains a liquid fabric glue for attachment of each pocket to a corresponding pants knee area. Each pocket may be attached to the pants' exterior knee area or interior knee area. Each pocket also contains a closable flap with a fastener such as a hook and pile fastener arrangement commonly sold under the VELCRO trademark. The kit provides three pairs of pads, one pair made from neoprene material or the like, the second pair made from a hard, plastic shell material or the like, and the third pair made from a lambs' wool material or the like. The neoprene and plastic pads are each adapted to fit into a pocket. The lamb's wool pads are adapted to being glued to the outside of a pocket if the pocket is attached to the interior of the pants; otherwise the lamb's wool pads are attached directly to the interior of the pants in the knee area.

With the kit of the present invention a person can adapt a pair of pants to a wide variety of situations needing knee protection. The pocket construction permits the same pants to be used under different environments requiring different protection needs.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
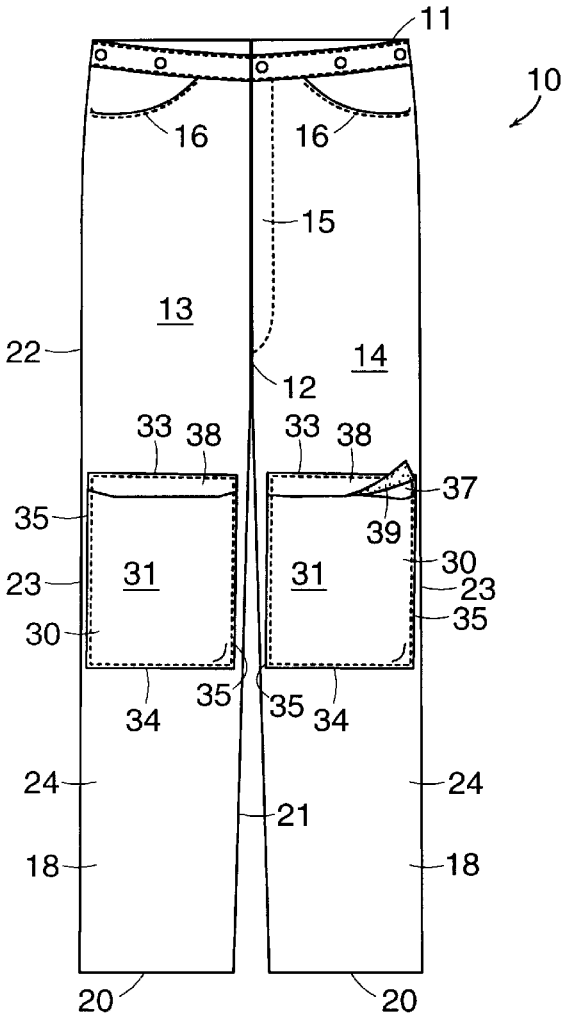
FIG. 1 is a front view of an invention pocket attached to the surface of the knee area of a pair of pants.
Figure 2:
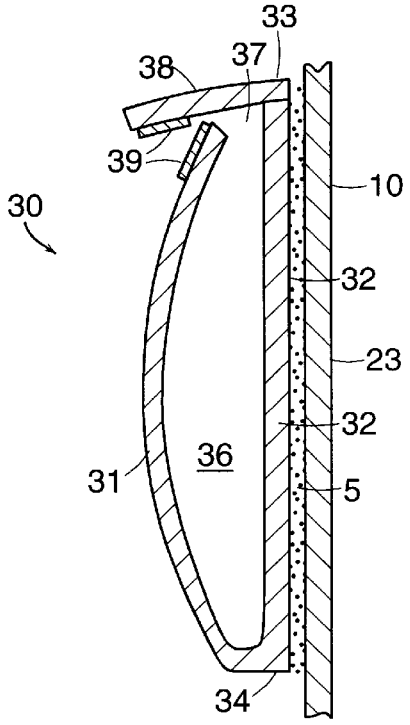
FIG. 2 is a cross-sectional view of the invention pocket attached to the knee area of a pair of pants.
Figure 4:
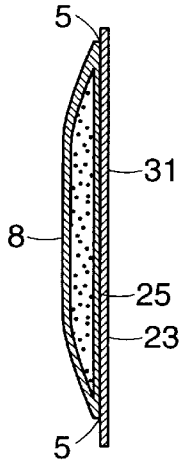
FIG. 4 illustrates the soft wool pads attached to a fabric surface.
Figure 3:
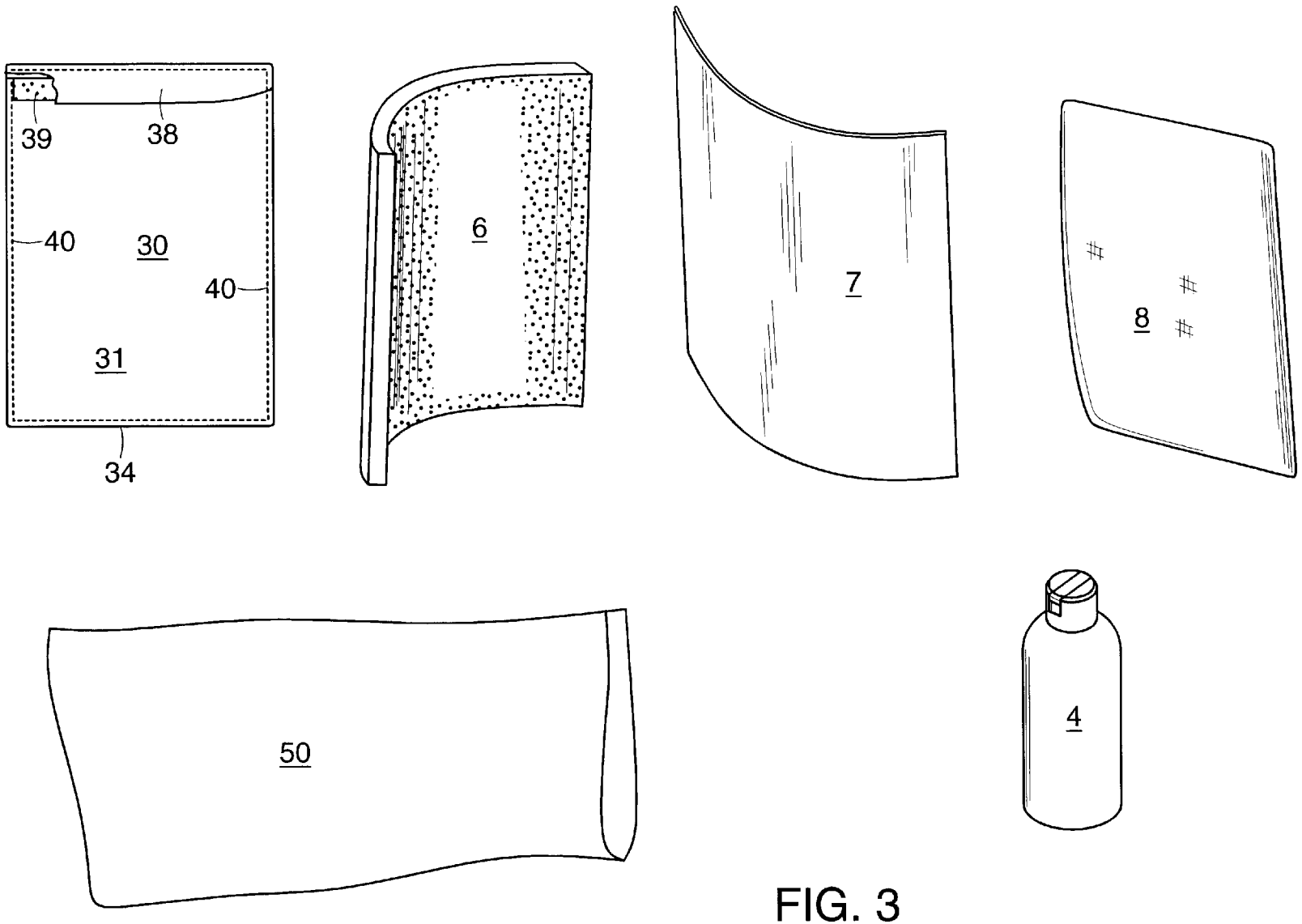
FIG. 3 illustrates each of the elements in an invention kit.

Referring to the drawings in detail wherein like elements are indicated by like numerals, there is shown a knee protection kit incorporating the features of the present invention. For purposes of illustration, there is shown a typical pair of pants 10 having a basic fabric structure suitably formed or made out of heavyweight washable material, preferably a cotton denim. The pants 10 have a waistband 11, a crotch area 12, a right leg member 13, a left leg member 14, a fly 15, and a conventional hand pocket 16. The left leg member 14 is a mirror image of the right leg member 13 and only details of the right leg member 13 will be recited. The right leg member 13 is formed by a front panel 18 and a rear panel 19. These panels suitably extend from the waistband 11 to the ankle end 20 of the leg member. The panels 18, 19 are joined along their side edges at an inseam 21 extending from the ankle end 20 to the crotch area 12 and an outseam 22 extending from the ankle end 20 upwardly to the waistband 11. Each leg member 13, 14 has a front knee area 23 located between the crotch area 12 and the ankle end 20. The pants 10 have an exterior surface 24 and an interior surface 25.

The kit of the present invention provides two separate fabric pockets 30 each with closable flap 38, a container 4 filled with liquid fabric glue 5, a pair of insert resilient pads 6, a pair of insert hard shells 7, and a pair of soft wool pads 8. The resilient insert pads 6 may be generally rectangular with dimensions less than those of the pocket. Each resilient insert pad 6 may be made from neoprene or similar material and is adapted to fit into a pocket interior 36. The insert hard shells 7 may be of any suitable shape and may be made from a hard material such as plastic. Each insert hard shell 7 has dimensions which adapt it to fitting into a pocket interior 36. The soft wool pads 8 may be made from lambs' wool and may be generally rectangular in shape and may be of any suitable dimensions. The kit may be initially contained in a kit storage bag 50 made out of a sturdy, lightweight material such as cardboard or plastic.

The attachable pockets 30 have a generally rectangular shape and are made preferably from a heavy-duty cotton denim. Each pocket 30 has a front surface 31, a rear surface 32, a top 33, a bottom 34, two sides 35 and an interior 36. The pocket interior 36 is accessible by a flap opening 37 preferably along the top 33. The flap 38 is fastened to the front surface 31 by a hook and pile fastener 39. Each pocket 30 is attached to a pants front knee area 23 by means of the liquid glue 5. A strip of glue 5 is applied to an inner perimeter 40 on the pocket rear surface 32. A pocket may be attached to the pants exterior surface 24 or interior surface 25. In either case, the pocket's rear surface 32 is glued directly to the pants 10. Each pocket 30 is attached to the pants 10 so that the longitudinal axis of the pocket, defined by the pocket's top 33 and bottom 34, is parallel with the longitudinal axis of a leg member 13, 14 which is defined by the waist band 11 and ankle end 20.

After the pockets have been attached to the pants' front knee areas 23, the wearer may consider the closed and empty pockets 30 as being sufficient protection for whatever task is before him. Alternatively, the wearer may insert a resilient insert pad 6 and/or a hard insert shell 7 into each pocket interior 36. The soft wool pads 8 are adapted to being glued to a pocket front surface 31 if the pocket 30 is attached to the interior surface 25 of the pants 10; otherwise the soft wool pads 8 are attached directly to the interior surface 25 of the pants' front knee area 23.

It is understood that the above-described embodiments are merely illustrative of the application. Other embodiments may be readily devised by those skilled in the art which will embody the principles of the invention and fall within the spirit and scope thereof.

I claim:

1. A knee protection kit for use in combination with pants having a waistband, a crotch area, a right leg member, a left leg member, said leg members extending along an outseam from the waistband to an ankle end, and along an inseam from the crotch area to an ankle end, each said leg member having a front knee area located between the crotch area and the ankle end, said pants having an exterior surface and an interior surface, comprising:

two separate fabric pockets, each said pocket having a front surface, a rear surface, a top, a bottom, two sides and an interior, said pocket interior being accessible by a flap opening along an edge thereof;

a container filled with a liquid fabric glue and for attaching each of said fabric pocket rear surface to a pants front knee area;

a pair of insert resilient pads, each of said resilient pads fitted into the respective pocket interior;

a pair of insert hard shells, each of said hard shells being adapted to being fitted into a pocket interior; and a pair of soft wool pads, wherein the soft wool pads are attachable to the respective pocket front surface when the pocket is attached to the interior surface of the pants, and wherein the soft wool pads are attachable directly to the interior surface of the pants' front knee area when the pocket is attached to the exterior surface of the pants.

2. A knee protection kit as recited in claim 1, wherein:

each said fabric pocket has a generally rectangular shape; and said opening flap is attached to the pocket front surface by a fastener.

3. A knee protection kit as recited in claim 2, wherein: the pocket rear surface is attachable directly to the pants.

4. A knee protection kit as recited in claim 3, wherein:

each fabric pocket is attachable to the pants so that a longitudinal axis of the pocket, defined by the pocket's top and bottom, is parallel with a leg member longitudinal axis defined by the waist band and ankle end.

5. A knee protection kit as recited in claim 4, wherein:

the resilient insert pads are generally rectangular with dimensions less than those of the fabric pocket interior.

6. A knee protection kit as recited in claim 5, wherein:

the insert hard shells are made from plastic.

7. A knee protection kit as recited in claim 6, wherein:

each resilient insert pad is made from neoprene.

8. A knee protection kit as recited in claim 7, wherein:

said fabric pockets are made from a heavy-duty cotton denim.

9. A knee protection kit as recited in claim 8, further comprising:

a kit storage bag made out of a sturdy, lightweight material.

* * * * *